United States Patent [19]

Mariani et al.

[11] 4,258,732

[45] Mar. 31, 1981

[54] SPIRALLY-SHAPED HAIR ROLLER

[76] Inventors: Rodolfo Mariani, Corso Saffi 27, Faenza; Francesco Pugliese, Via Canova 35, Milan, both of Italy

[21] Appl. No.: 20,701

[22] Filed: Mar. 15, 1979

[30] Foreign Application Priority Data

Mar. 23, 1978 [IT] Italy ..... 21240/78[U]

[51] Int. Cl.[3] ..... A45D 2/26

[52] U.S. Cl. ..... 132/41 R

[58] Field of Search ..... 132/40, 41, 42, 38, 132/39

[56] References Cited

U.S. PATENT DOCUMENTS

| | | | |
|---|---|---|---|
| 1,477,873 | 12/1923 | Jacobs | 132/41 R |
| 1,652,356 | 12/1927 | Hammerly | 132/38 |
| 2,429,176 | 10/1947 | Watson | 132/40 |
| 2,783,763 | 3/1957 | King | 132/41 R |
| 2,801,639 | 8/1957 | Barth | 132/40 |
| 3,500,836 | 3/1970 | Jordan | 132/40 |

*Primary Examiner*—Gregory E. McNeill

*Attorney, Agent, or Firm*—McGlew and Tuttle

[57] ABSTRACT

A hair roller for the curling and the setting of hair comprising a main spirally-shaped element apt to receive on said spiral the lock of hair being wound thereon, beginning from the roots and ending at the tips of said hair, and a secondary element consisting of a cylindrical sheath having a plurality of openings and a longitudinal slit extending through the length of said sheath.

7 Claims, 2 Drawing Figures

SPIRALLY-SHAPED HAIR ROLLER

BACKGROUND OF THE INVENTION

The present invention relates to a hair roller for curling and setting the hair consisting of a main spirally-shaped body, on which spirals there is wound the lock of hair beginning at the roots thereof up to the tips of said hair, and of a sheath slidable and rotatable with respect to said main body, said sheath having thereon holes and a longitudinal opening or slot.

There are presently known numerous types of hair rollers for the curling and the setting of hair but they all present various inconveniences, even conceptual, such as in particular that of providing for the winding of the hair beginning at the tips thereof to arrive, when the winding operation is completed, at the roots.

SUMMARY OF THE INVENTION

To eliminate said inconveniences, the present invention proposes a hair roller composed of two distinct pieces, the main one, to be utilized in a fixed position, provided with a long spiral interrupted at one end and the other consisting of a substantially cylindrical sheath, fittable and slidable axially with respect to the main piece, and having a series of openings and a longitudinal slot so as to obtain the following characteristics:

(I) The lock of hair is wound on the spirally-shaped element beginning at the roots and proceeding toward the tips of the hair itself;

(II) On the terminal end of the spirally-shaped element there is provided a housing into which the spiral does not extend and in which there may be wound the eventual part of the lock which is not contained onto the spiral;

(III) The spirally-shaped element is covered by a sheath which has thereon holes or slits apt to permit the passage and the penetration in the lock of liquids and substances for the curling and the setting operation and/or of the air to effect the drying operation, said sheath being provided with a longitudinal slit which permits the operator to control the action of the curling substances on the hair and the progression of the winding operation;

(IV) While the spirally-shaped element remains fixed, the perforated sheath is made to rotate by the operator in a manner such that the lock of hair is gradually inserted onto the spiral since, in this insertion, it is guided by the particular conformation of one of the ends of the perforated sheath;

(V) The two parts which comprise the hair roller may be of a plastic material or of any other kind of material, even transparent, the same or preferably different with respect to each other so as to obtain a rigid spirally-shaped main body and a flexible, semirigid or rigid sheath.

Thus, it is an object of the invention to provide a hair roller for the curling and setting of hair which includes a cylindrical central body having an integral helicoidal spiral portion spirally extending over a portion of the surface of the central body to define a continuous helicoidal space along the central body. A cylindrical sheath is movably mounted over the central body and is operative to move rotatably and axially in respect to the cylindrical body. The sheath is provided with a longitudinal slot extending along the entire length thereof and has a plurality of apertures extending through the sheath to define passages for liquids and substances for curling and setting operation. The longitudinal slot is preferably formed with a portion extending at an oblique angle in respect to the longitudinal axis thereof at one end of the longitudinal slot.

It is a further object of the invention to provide a hair roller which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
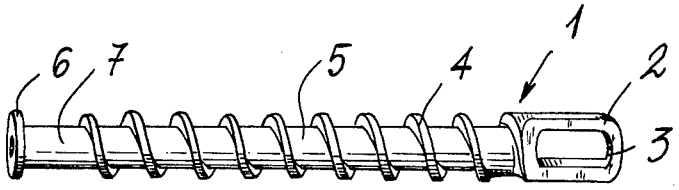
FIG. 1 shows a perspective view of the main spirally-shaped body of the hair roller according to the present invention.
Figure 2:
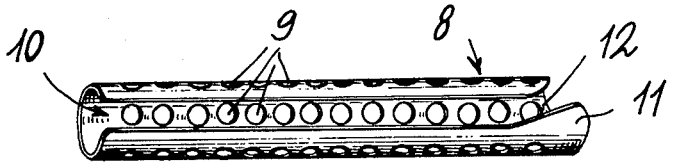
FIG. 2 shows a perspective view of the perforated sheath which must be fitted on the element of FIG. 1 for the winding of the lock of hair.

A hair roller according to the invention consists essentially of a main body 1 terminating at one end with a handle 2, having a central opening 3. The body which is then stamped with a helicoidal spiral 4 in relief with respect to the cylindrical central body 5 so as to obtain a broad continuous helicoidal hollow space along the body 1. The spiral 4 terminates before reaching a the disk-shaped end 6 so as to leave a broad zone of central body 5 free of threads.

According to the invention, there is then provided a second body 8 consisting of a cylindrical sheath with numerous series of holes or similar openings along all its surface; the sheath 8 is also provided with a large longitudinal slot 10 extending along the entire length of the sheath. Finally, the sheath itself ends in a protuberance 11 (always lying on the cylindrical surface), the projection of which is substantially equal or slightly greater than the transversal width of the slot 10. In this manner the slot 10 terminates at one end which a section 12 inclined with respect to the main section of the slot. As results evident from the above, the sheath 8 is snapped onto body 1 for the utilization as the hair roller and, thanks to its conformation, can axially slide freely parallel to the elongated axis of said body 1 (maintained fixed) and rotate about the elongated axis of the body 1 in order to determine the winding of the lock along the helicoidal recess, within the spiral 4, beginning from the end corresponding to the handle or head 2 and terminating in the wider recess 7, i.e. the broad zone of central body 5, which does not present a spiral configuration. As noted hereinbefore, a peculiar characteristic of the hair roller of the present invention is to permit the winding of the lock of hair beginning at the roots of the hair and terminating at the tips thereof. The function of the openings 9 and of the slit 10 has already been described in detail. The function of the protuberance 11 is the guiding of the lock in the winding into the continuous helicoidal spaces 5.

Obviously, the dimensions, the materials used, as well as the non-substantial particular forms of realization may vary considerably according to the particular requirements of use and to the functionality of operation.

What is claimed is:

1. A hair roller for the curling and the setting of hair comprising a cylindrical central body having a spirally-shaped element on said body adapted to receive a lock of hair being wound thereon, beginning from the roots and ending at the tips of said hair, and a cylindrical sheath having a plurality of openings and a longitudinal slot extending through the length of said sheath mounted on said central body and operative to move axially parallel to and rotatably about the elongated axes of said cylindrical central body.

2. A hair roller according to claim 1, wherein a terminal end of said central body is formed free of said spiral configuration and is adapted to receive the eventual portion of the lock of hair not contained in the spirally-shaped section.

3. A hair roller according to claim 1, wherein said cylindrical sheath has openings thereon adapted to permit the passage and the penetration into the hair of liquids and substances for the curling and setting operations.

4. A hair roller according to claim 1, wherein said cylindrical sheath is rotatable on the spirally-shaped element, which remains fixed, so that the lock of hair is gradually inserted on to the spirals, being guided by the conformation of the sheath, and said sheath having a raised protuberance which causes the longitudinal slot to have, at the one end thereof, an oblique configuration.

5. A hair roller according to claim 1, wherein said central body is rigid and said sheath is rigid, semirigid or flexible, and both central body and said sheath are of a plastic material.

6. A hair roller for the curling and setting of hair comprising a cylindrical central body having an integral helicoidal spiral portion spirally extending over a portion of the surface of said central body to define a continuous helicoidal space along said central body, a cylindrical sheath movably mounted over said central body, said sheath being operative to move rotatably about and axially parallel to the elongated axis of said cylindrical central body, said sheath having a longitudinal slot extending along the entire length thereof and having a plurality of apertures extending through said sheath to define passages for liquids and substances for curling and setting operations.

7. A hair roller according to claim 6, wherein said longitudinal slot has a portion extending at an oblique angle in respect to the longitudinal axis thereof at one end of said longitudinal slot.

* * * * *